US011649016B2

(12) United States Patent
Empacher

(10) Patent No.: US 11,649,016 B2
(45) Date of Patent: May 16, 2023

(54) EIGHT

(71) Applicant: Empacher Verwaltungs GmbH & Co. KG, Eberbach (DE)

(72) Inventor: Helmut Empacher, Neckarsteinach (DE)

(73) Assignee: Empacher Verwaltungs GmbH & Co. KG, Eberbach (DE)

( * ) Notice: Subject to any disclaimer, the term of this patent is extended or adjusted under 35 U.S.C. 154(b) by 163 days.

(21) Appl. No.: 17/242,795

(22) Filed: Apr. 28, 2021

(65) Prior Publication Data

US 2022/0033038 A1 Feb. 3, 2022

(30) Foreign Application Priority Data

Jul. 30, 2020 (DE) ..... 10 2020 120 122.2

(51) Int. Cl.
*B63B 34/30* (2020.01)
*B63B 1/04* (2006.01)
*B63B 3/14* (2006.01)

(52) U.S. Cl.
CPC ..... *B63B 34/30* (2020.02); *B63B 1/04* (2013.01); *B63B 3/14* (2013.01)

(58) Field of Classification Search
CPC .. B63B 34/30; B63B 1/04; B63B 3/14; B63B 71/00
See application file for complete search history.

(56) References Cited

U.S. PATENT DOCUMENTS 5,067,426 A * 11/1991 Vespoli ..... B63B 1/04 114/61.3
5,474,008 A * 12/1995 Vespoli ..... B63B 1/04 114/56.1

FOREIGN PATENT DOCUMENTS

DE 19622970 A1 * 12/1997 ..... B63B 1/04

* cited by examiner

*Primary Examiner* — Anthony D Wiest
(74) *Attorney, Agent, or Firm* — Renner, Kenner, Greive, Bobak, Taylor & Weber

(57) ABSTRACT

The men's eight according to the invention has an elongated hull that ends in a pointed bow and a pointed stern. Given a total weight of 938 kg, the waterline is 17,211 mm±5%, preferably ±3% and most preferably ±2%. Given division into 15 segments of equal length and in the case of a total weight of 938 kg, particular values are also presented in table form for the respective cross-sectional area below the waterline WL, the respective circumference below the waterline WL, the respective width at the waterline WL, and the respective width ratio based on the middle segment 7, each having a tolerance of ±5%, preferably ±3% and most preferably ±2%. The women's eight according to the invention is designed with similar lines for a total weight of 858 kg.

6 Claims, 4 Drawing Sheets

EIGHT

Figure 1:
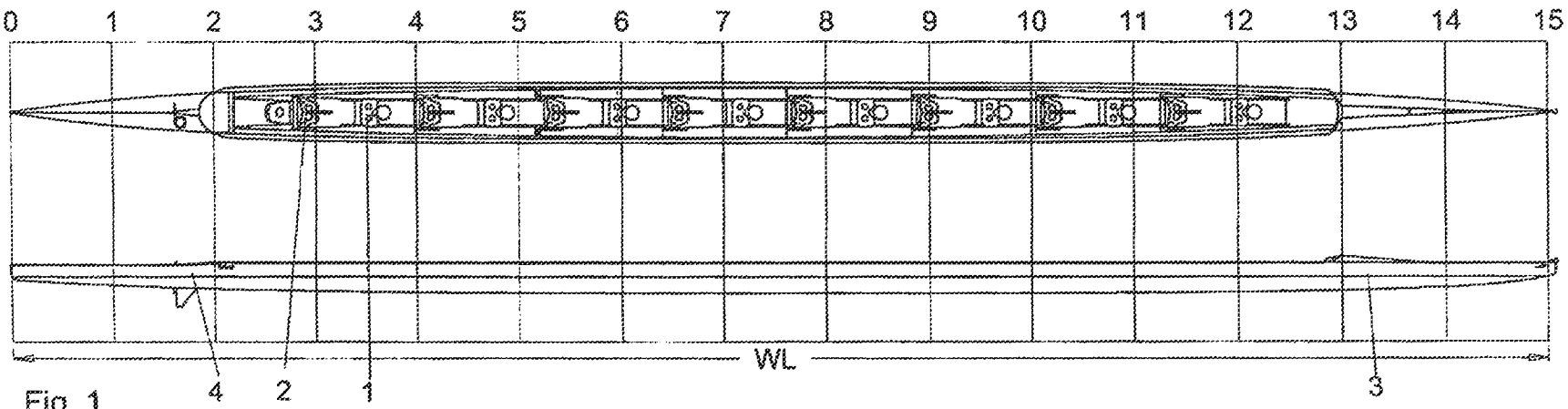

The invention relates to an eight having an elongated hull that ends in a pointed bow and a pointed stern.

A men's eight developed by the applicant and used very successfully since 1996 is known to a person skilled in the art by the name "R86." At a total weight of 938 kg, it has the following specifications:

The waterline is 17,131 mm and, given division into 15 segments of equal length, the respective cross-sectional area below the waterline, the respective circumference below the waterline, the respective width at the waterline and the respective width ratio based on the middle segment 7 have the values shown in the following table:

| Segment cuts or ribs | Area below the waterline [cm$^2$] | Circumference below the waterline [mm] | Width at the waterline [mm] | Width ratios (rib 7/rib x) |
|---|---|---|---|---|
| 1 | 166.3 | 294.5 | 204.7 | 0.365 |
| 2 | 323.9 | 456.7 | 332.2 | 0.593 |
| 3 | 506.9 | 572.3 | 420.2 | 0.750 |
| 4 | 654.0 | 651.6 | 482.9 | 0.862 |
| 5 | 756.5 | 702.0 | 522.8 | 0.933 |
| 6 | 824.0 | 734.0 | 548.3 | 0.979 |
| 7 | 856.6 | 749.0 | 559.9 | 1 |
| 8 | 859.2 | 750.4 | 561.4 | 1.003 |
| 9 | 828.5 | 736.6 | 552.2 | 0.986 |
| 10 | 763.4 | 705.7 | 526.9 | 0.941 |
| 11 | 659.3 | 653.7 | 483.2 | 0.863 |
| 12 | 516.6 | 575.7 | 414.4 | 0.740 |
| 13 | 350.2 | 412.1 | 318.3 | 0.568 |
| 14 | 164.1 | 328.6 | 189.9 | 0.339 |

The corresponding women's eight was developed from the men's eight by shortening the upper collar by 3 cm and installing the decks 2 cm deeper in the boat. For the women's eight, which is likewise known to a person skilled in the art by the name "R86," this resulted in the following values for the respective cross-sectional area below the waterline, the respective circumference below the waterline, the respective width at the waterline and the respective width ratio based on the middle segment 7 at a total weight of 858 kg and with a waterline of 17,071:

| Segment cuts or ribs | Area below the waterline [cm$^2$] | Circumference below the waterline [mm] | Width at the waterline [mm] | Width ratios (rib 7/rib x) |
|---|---|---|---|---|
| 1 | 115.4 | 272.9 | 199.2 | 0.358 |
| 2 | 207.8 | 433.5 | 324.7 | 0.583 |
| 3 | 459.8 | 548.4 | 412.2 | 0.741 |
| 4 | 598.9 | 627.4 | 475.5 | 0.855 |
| 5 | 696.3 | 677.9 | 516.2 | 0.928 |
| 6 | 760.5 | 709.9 | 542.3 | 0.975 |
| 7 | 791.7 | 725.1 | 556.1 | 1 |
| 8 | 794.3 | 726.5 | 554.5 | 0.997 |
| 9 | 764.3 | 712.8 | 546.1 | 0.982 |
| 10 | 703.7 | 682.1 | 520.8 | 0.936 |
| 11 | 605.7 | 650.5 | 477.0 | 0.857 |
| 12 | 472.1 | 553.1 | 408.2 | 0.734 |
| 13 | 317.6 | 450.5 | 313.2 | 0.563 |
| 14 | 147.4 | 309.4 | 187.5 | 0.337 |

After 24 years, the two eights with the name "R86" are still the most successful eight designs of all time. Nevertheless, the applicant has set itself the object of further reducing the overall drag resulting from form, friction, wave and ramming resistance considerably.

According to the invention, this object is achieved by the features of claims 1 and 6.

The men's eight according to the invention has an elongated hull that ends in a pointed bow and a pointed stern. At a total weight of 938 kg, the waterline is 17,211 mm±5%, preferably ±3% and most preferably ±2%. Given division into 15 segments of equal length and in the case of a total weight of 938 kg, the following values are also present for the respective cross-sectional area below the waterline WL, the respective circumference below the waterline WL, the respective width at the waterline WL and the respective width ratio based on the middle segment 7, each having a tolerance of ±5%, preferably ±3% and most preferably ±2%:

| Segment cuts or ribs | Area below the waterline [cm$^2$] | Circumference below the waterline [mm] | Width at the waterline [mm] | Width ratios (rib 7/rib x) |
|---|---|---|---|---|
| 1 | 152.89 | 311.7 | 214.4 | 0.387 |
| 2 | 366.23 | 485.3 | 350.6 | 0.633 |
| 3 | 540.49 | 592.2 | 434.6 | 0.785 |
| 4 | 662.88 | 658.84 | 489.7 | 0.885 |
| 5 | 742.86 | 700.05 | 525.5 | 0.950 |
| 6 | 787.55 | 722.55 | 545.7 | 0.986 |
| 7 | 807.05 | 731.99 | 553.0 | 1 |
| 8 | 807.88 | 731.68 | 550.1 | 0.995 |
| 9 | 789.97 | 721.86 | 538.6 | 0.973 |
| 10 | 748.12 | 699.51 | 514.7 | 0.930 |
| 11 | 673.43 | 659.48 | 472.0 | 0.853 |
| 12 | 550.3 | 591.83 | 404.6 | 0.731 |
| 13 | 373.62 | 485.75 | 308.1 | 0.557 |
| 14 | 163.19 | 325.82 | 179.7 | 0.324 |

The total weight of 938 kg is based on an average weight per rower of 95 kg.

The women's eight according to the invention has an elongated hull that ends in a pointed bow and a pointed stern. At a total weight of 858 kg, the waterline is 16,793 mm±5%, preferably ±3% and most preferably ±2%. Given division into 15 segments of equal length and in the case of a total weight of 858 kg, the following values are also present for the respective cross-sectional area below the waterline WL, the respective circumference below the waterline WL, the respective width at the waterline WL and the respective width ratio based on the middle segment 7, each having a tolerance of ±5%, preferably ±3% and most preferably ±2%:

| Segment cuts or ribs | Area below the waterline [cm$^2$] | Circumference below the waterline [mm] | Width at the waterline [mm] | Width ratios (rib 7/rib x) |
|---|---|---|---|---|
| 1 | 140.5 | 299.6 | 211.5 | 0.387 |
| 2 | 345.7 | 472.8 | 346.3 | 0.634 |
| 3 | 488.1 | 576.6 | 429.3 | 0.786 |
| 4 | 623.0 | 641.6 | 483.7 | 0.885 |
| 5 | 698.0 | 681.8 | 519.0 | 0.950 |
| 6 | 739.9 | 704.0 | 539.9 | 0.988 |
| 7 | 758.1 | 713.2 | 546.1 | 1 |
| 8 | 758.9 | 712.8 | 523.2 | 0.994 |
| 9 | 741.9 | 703.0 | 531.8 | 0.973 |
| 10 | 702.8 | 681.0 | 508.3 | 0.933 |
| 11 | 632.5 | 641.4 | 466.0 | 0.853 |
| 12 | 516.8 | 574.8 | 399.5 | 0.731 |
| 13 | 351.1 | 470.8 | 304.0 | 0.556 |
| 14 | 151.9 | 313.0 | 177.3 | 0.324 |

The total weight of 858 kg is based on an average weight per rower of 85 kg.

To reduce drag, the cross section in the middle of the boat was first reduced by reducing the area below the waterline at rib 7 of the men's eight from 856.6 $cm^2$ to 807.05 $cm^2$. In the women's eight, the area below the waterline at rib 7 was reduced from 791.7 $cm^2$ to 758.1. This means an effective cross section reduction in the middle of the boat by 5.8% and 4.2% respectively.

However, reducing the cross section also makes the boat more sensitive and less stable. According to the invention, this was compensated for by differently shaped rib cross sections and by a different form of distribution of the displacement volume over the length.

The changed or flattened rib or cross-sectional profiles in the bow and midship region produce more dynamic buoyancy and lateral stability there starting at a certain speed compared to the rib cross sections of the R86 eight.

At racing speed, the missing cross section in the middle of the boat is replaced by a different profile and distribution by moving the missing displacement from the middle of the boat to the ends of the boat. In the case of the new lines at the ends of the boat, however, care had to be taken to ensure that the gain in drag from the middle was not canceled out by decelerating, thick ends of the boat.

Moreover, the latest findings on oar strokes have been incorporated into the design of the hull. It had to be taken into account that it is not possible to produce dynamic buoyancy in the stern to stabilize the boat at the beginning of the stroke when the athlete's mass is shifted to the stern. This problem was solved by increasing the longitudinal inertia, i.e., the resistance of the boat shape to the displacement of the crew weight by the oar stroke. This was achieved by providing more voluminous boat ends, especially in the stern region. This has the effect of generating more buoyancy volume when the stern dips deeper at the start of the stroke. For this reason, the stern of the new men's eight is 14.4 mm wider at rib 3 than the R86 predecessor boat, which increased the longitudinal moment of inertia of the waterline area by 1.21% compared to the R86 predecessor boat.

It was possible to reduce the drag of the new men's eight in simulation calculations in various floating and speed conditions by 3.1 to 3.5% compared to the R86 predecessor boat while at the same time improving the rowing properties.

The women's eight according to the invention was developed from the new men's eight, the linear shape and thus the rowing characteristics being retained. The men's eight according to the invention was scaled down to the lower displacement of 858 kg and the less strong physique of the women's team. However, the plan of the men's eight had to be reduced in length, width and depth differently in order to ultimately get a smaller eight that, however, has the same lines, which are characterized in particular by a cross section reduction in the middle of the boat and a wider stern.

The gain in drag in the simulation of the women's eight according to the invention compared to the previous R88 model, which was loaded with only 858 kg, is a remarkable 5.1-5.3%.

Further embodiments and advantages of the invention are explained in more detail below with reference to the drawings and the description.

Figure 2:
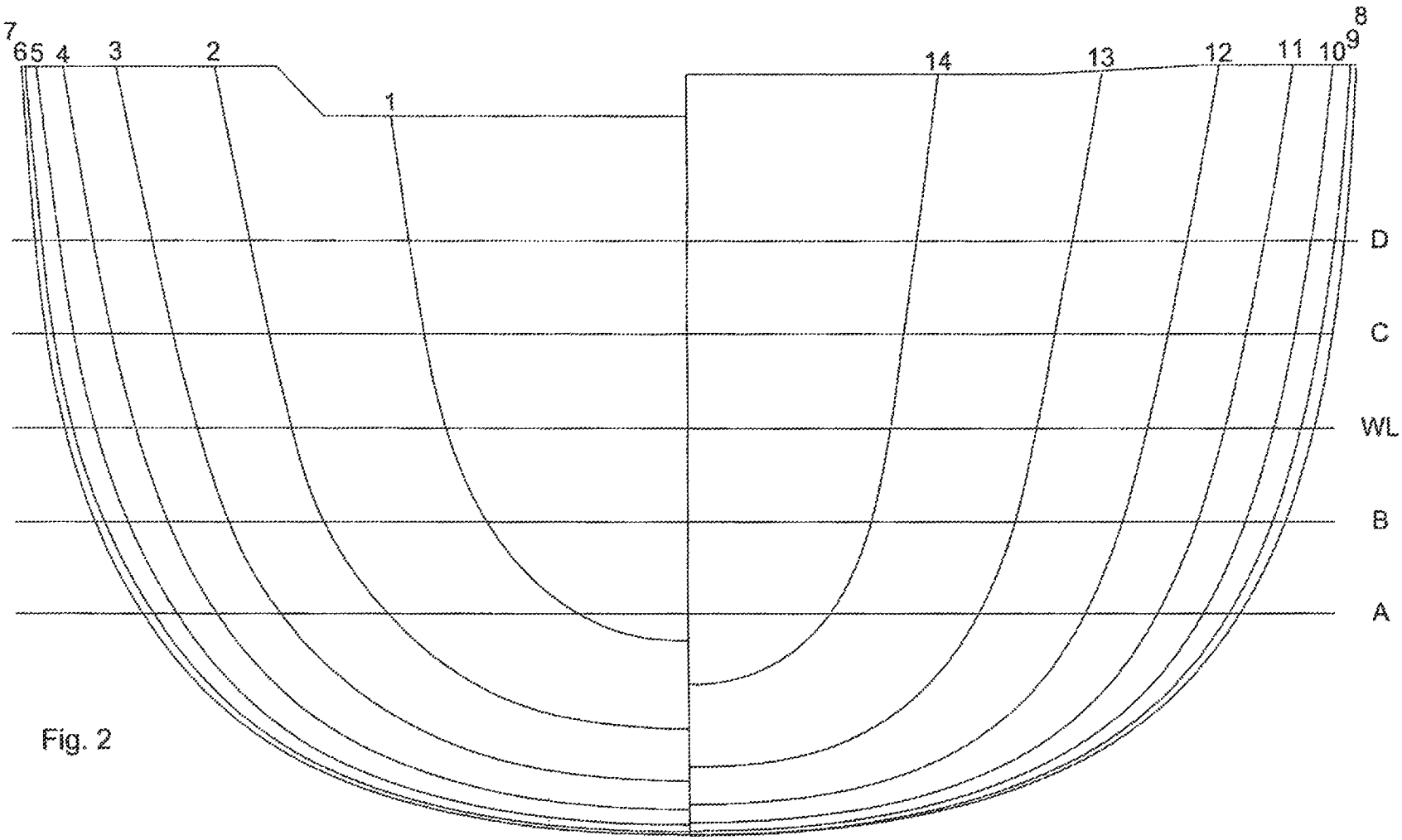
Figure 3:
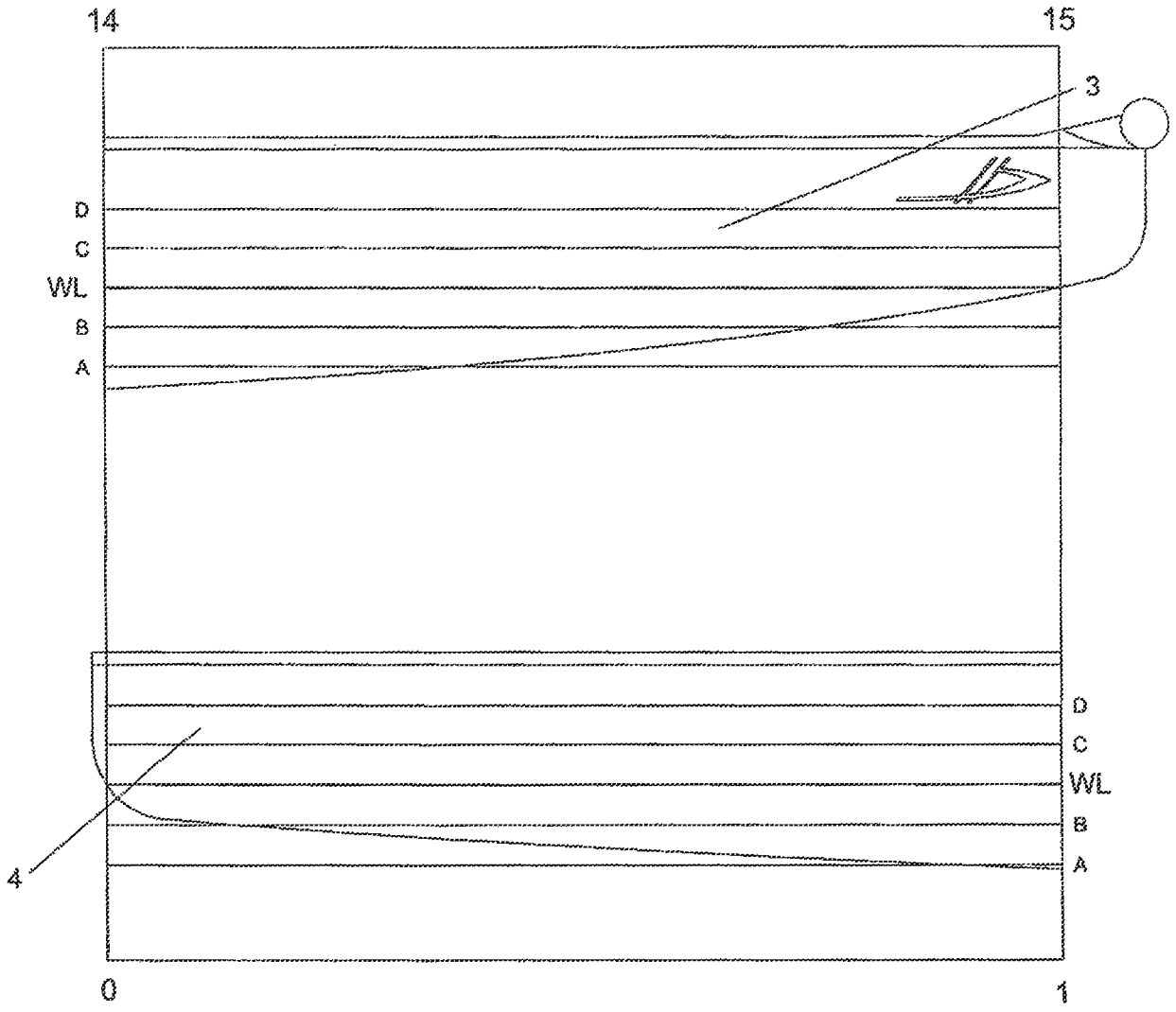
Figure 4:
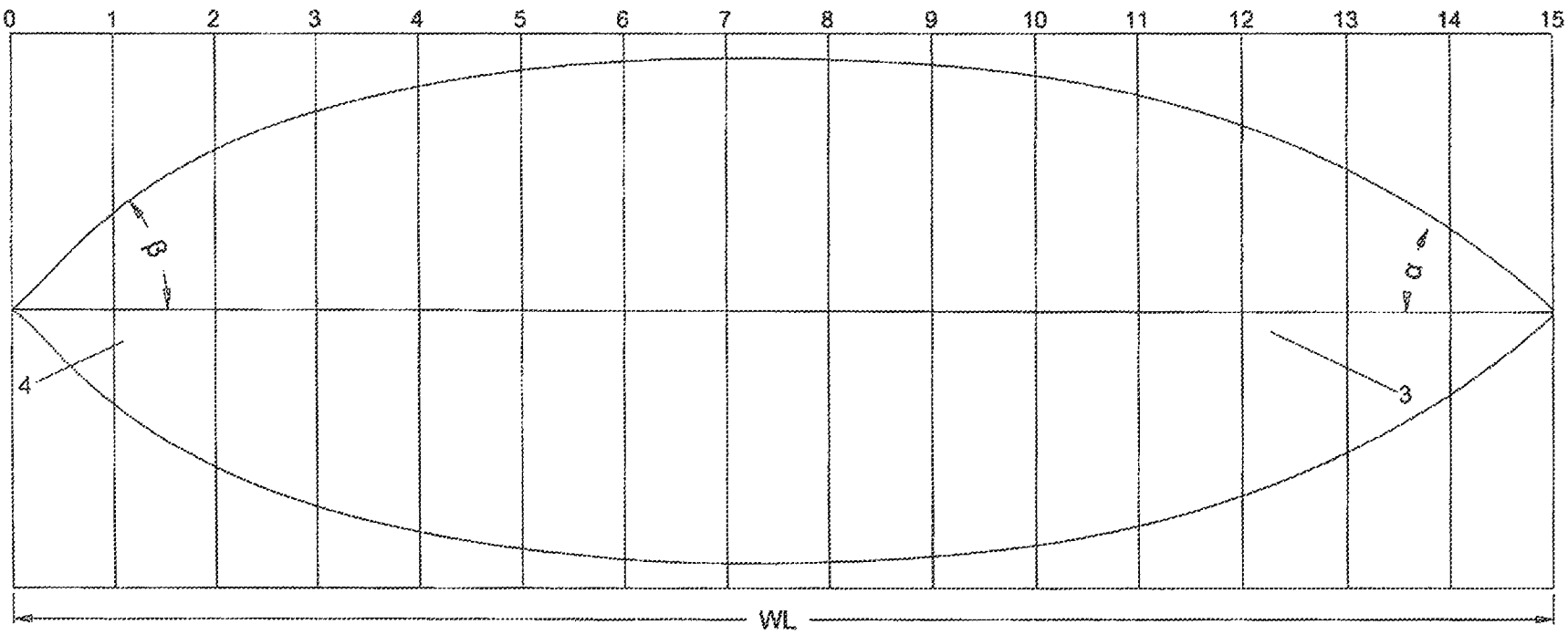

In the drawings:

FIG. 1 is a schematic representation of the eight in side view and in plan view, FIG. 2 is a representation of the boat plan of the eight showing the individual segment sections as well as the width ratios along the waterline, FIG. 3 is a representation of the bow profile and the stern profile and FIG. 4 is a representation of the lead angles of the stern and bow.

FIG. 1 shows the basic structure of the men's and women's eight according to the invention, specifically the arrangement of the sliding seats 1 and the foot stretchers 2 as well as the bow 3 and the stern 4. This figure shows the particularly narrow design, i.e., in particular the very small ratio of total width to total length.

The shape of the ribs can be seen in FIG. 2. The length of the waterline WL for the men's eight at a total weight of 938 kg is 17,211 mm±5%, preferably ±3%, most preferably ±2%. The total length of the men's eight according to the invention is 17,320 mm. The length of the waterline WL in the women's eight according to the invention at a total weight of 858 kg is 16,793 mm±5%, preferably ±3%, most preferably ±2%. The total length of the women's eight according to the invention is 16,890 mm.

The views of the bow 3 and the stern 4 can be seen in FIG. 3.

FIG. 4 is a representation shortened in the longitudinal direction with a scale of 1:10 in which the lead angle $\alpha$ of the bow 3 and the lead angle $\beta$ of the stern 4 are illustrated on an enlarged scale. The angles for the men's eight are $\alpha$=4.8°±5%, preferably ±3%, most preferably ±1% and $\beta$=5.9°±5%, preferably ±3%, most preferably ±1%. The corresponding angles for the women's eight are $\alpha$=4.8°±5%, preferably ±3%, most preferably ±1% and $\beta$=5.4°±5%, preferably ±3%, most preferably ±1%.

Given the division into 15 segment sections/ribs having the same spacing, which can be seen in FIG. 4, the values already given above for the respective cross-sectional area below the waterline WL, the respective circumference below the waterline WL, the respective width at the waterline WL and the respective width ratio based on the middle segment 7 are obtained for the men's eight and women's eight.

The invention claimed is:

1. An eight having an elongated hull that ends in a pointed bow (3) and a pointed stern (4), characterized in that a lead angle ($\alpha$) of the bow (3) at the waterline (WL) is 4.8°±5%;

a lead angle ($\beta$) of the stern (4) at the waterline (WL) is 5.9°±5%;

given a total weight of 938 kg, a waterline (WL) is 17,211 mm ±5%, and given division into 15 segments of equal length by 14 segment cuts, in the case of a total weight of 938 kg, the following values are present for a respective cross-sectional area below the waterline WL, a respective perimeter below the waterline WL, a respective width at the waterline WL, and a respective width ratio based on segment cut 7 of the 14 segment cuts, each having a tolerance of ±5%:

| Segment cuts or ribs | Area below the waterline [$cm^2$] | Circumference below the waterline [mm] | Width at the waterline [mm] | Width ratios (rib 7/rib x) |
|---|---|---|---|---|
| 1 | 152.89 | 311.7 | 214.4 | 0.387 |
| 2 | 366.23 | 485.3 | 350.6 | 0.633 |
| 3 | 540.49 | 592.2 | 434.6 | 0.785 |
| 4 | 662.88 | 658.84 | 489.7 | 0.885 |
| 5 | 742.86 | 700.05 | 525.5 | 0.950 |
| 6 | 787.55 | 722.55 | 545.7 | 0.986 |
| 7 | 807.05 | 731.99 | 553.0 | 1 |
| 8 | 807.88 | 731.68 | 550.1 | 0.995 |
| 9 | 789.97 | 721.86 | 538.6 | 0.973 |
| 10 | 748.12 | 699.51 | 514.7 | 0.930 |

-continued

| Segment cuts or ribs | Area below the waterline [cm$^2$] | Circumference below the waterline [mm] | Width at the waterline [mm] | Width ratios (rib 7/rib x) |
|---|---|---|---|---|
| 11 | 673.43 | 659.48 | 472.0 | 0.853 |
| 12 | 550.3 | 591.83 | 404.6 | 0.731 |
| 13 | 373.62 | 485.75 | 308.1 | 0.557 |
| 14 | 163.19 | 325.82 | 179.7 | 0.324 |

2. The eight according to claim 1, characterized in that, given a total weight of 938 kg, the waterline (WL) is 17,211 mm ±3%.

3. The eight according to claim 1, characterized in that the values for the respective cross-sectional area below the waterline WL, the respective perimeter below the waterline WL, the respective width at the waterline WL, and the respective width ratio based on segment cut 7 are in each case present with a tolerance of ±3%.

4. An eight having an elongated hull that ends in a pointed bow (3) and a pointed stern (4), characterized in that a lead angle (α) of the bow (3) at the waterline (WL) is 4.8°±5%;

a lead angle (β) of the stern (4) at the waterline (WL) is 5.9°±5%;

given a total weight of 858 kg, a waterline (WL) is 16,793 mm ±5%, and given division into 15 segments of equal length by 14 segment cuts, in the case of a total weight of 858 kg, the following values are present for a respective cross-sectional area below the waterline WL, a respective perimeter below the waterline WL, a respective width at the waterline WL and a respective width ratio based on segment cut 7 of the 14 segment cuts, each having a tolerance of ±5%:

| Segment cuts | Area below the waterline [cm$^2$] | Perimeter below the waterline [mm] | Width at the waterline [mm] | Width ratios (segment x/segment 7) |
|---|---|---|---|---|
| 1 | 140.5 | 299.6 | 211.5 | 0.387 |
| 2 | 345.7 | 472.8 | 346.3 | 0.634 |
| 3 | 488.1 | 576.6 | 429.3 | 0.786 |
| 4 | 623.0 | 641.6 | 483.7 | 0.885 |
| 5 | 698.0 | 681.8 | 519.0 | 0.950 |
| 6 | 739.9 | 704.0 | 539.9 | 0.988 |
| 7 | 758.1 | 713.2 | 546.1 | 1 |
| 8 | 758.9 | 712.8 | 523.2 | 0.994 |
| 9 | 741.9 | 703.0 | 531.8 | 0.973 |
| 10 | 702.8 | 681.0 | 508.3 | 0.933 |
| 11 | 632.5 | 641.4 | 466.0 | 0.853 |
| 12 | 516.8 | 574.8 | 399.5 | 0.731 |
| 13 | 351.1 | 470.8 | 304.0 | 0.556 |
| 14 | 151.9 | 313.0 | 177.3 | 0.324. |

5. The eight according to claim 4, characterized in that, given a total weight of 858 kg, the waterline (WL) is 16,793 mm ±3%.

6. The eight according to claim 4, characterized in that the values for the respective cross-sectional area below the waterline WL, the respective perimeter below the waterline WL, the respective width at the waterline WL and the respective width ratio based on segment cut 7 are in each case present with a tolerance of ±3%.

* * * * *